US009708086B2

(12) United States Patent
Bianchi

(10) Patent No.: US 9,708,086 B2
(45) Date of Patent: Jul. 18, 2017

(54) METHOD AND MACHINE FOR PRODUCING A SINGLE-USE CAPSULE FOR BEVERAGES AND CAPSULE OBTAINED USING METHOD

(71) Applicant: IMA INDUSTRIES S.R.L., Ozzano Dell'Emilia (Bologna) (IT)

(72) Inventor: Mauro Bianchi, Castenaso (IT)

(73) Assignee: GIMA, S.P.A., Zola Predosa (IT)

( * ) Notice: Subject to any disclaimer, the term of this patent is extended or adjusted under 35 U.S.C. 154(b) by 575 days.

(21) Appl. No.: 14/349,248

(22) PCT Filed: Oct. 31, 2012

(86) PCT No.: PCT/IB2012/056042

§ 371 (c)(1),
(2) Date: Apr. 2, 2014

(87) PCT Pub. No.: WO2013/064988

PCT Pub. Date: May 10, 2013

(65) Prior Publication Data

US 2014/0230370 A1 Aug. 21, 2014

(30) Foreign Application Priority Data

Nov. 4, 2011 (IT) ..... BO2011A0621

(51) Int. Cl.
*B65B 29/02* (2006.01)
*B65B 1/02* (2006.01)
(Continued)

(52) U.S. Cl.
CPC ..... *B65B 29/02* (2013.01); *B65B 1/02* (2013.01); *B65B 7/164* (2013.01); *B65B 61/20* (2013.01); *B65D 85/8043* (2013.01)

(58) Field of Classification Search
CPC B65B 29/02; B65B 1/02; B65B 61/20; B65B 7/164; B65B 29/06; B65B 7/2842;
(Continued)

(56) References Cited

U.S. PATENT DOCUMENTS 4,859,337 A * 8/1989 Woltermann ..... A47J 31/02 210/474
4,995,310 A * 2/1991 van der Lijn ..... B65D 85/8043 210/282
(Continued)

FOREIGN PATENT DOCUMENTS

EP 0524464 1/1993
EP 1167204 A1 1/2002
(Continued)

*Primary Examiner* — Robert Long
*Assistant Examiner* — Xavier A Madison
(74) *Attorney, Agent, or Firm* — Pearne & Gordon LLP

(57) ABSTRACT

A method for producing a single-use capsule (1) for extraction beverages comprises the steps of: positioning a flat piece (8) of filter paper over a cup-shaped rigid body (2); joining the flat piece (8) of filter paper along at least the rim (7) of the rigid body (2); forming the piece (8) of filter paper towards the interior of the rigid body (2) and by means of plastic deformation of the piece (8) of filter paper so as to define a containment chamber (5); filling of the containment chamber (5) with a dose (D) of product; closing of the chamber (5) and of the external rigid body (2) with a sheet lid (6). This invention also relates to a machine (100) which implements said method.

12 Claims, 3 Drawing Sheets

(51) Int. Cl.
*B65B 61/20* (2006.01)
*B65B 7/16* (2006.01)
*B65D 85/804* (2006.01)

(58) Field of Classification Search
CPC ..... B65B 3/10; A47J 31/08; B65D 85/808; B65D 85/8043
USPC ..... 426/115, 86, 394, 425, 77; 53/410, 471; 493/56
See application file for complete search history.

(56) References Cited

U.S. PATENT DOCUMENTS

| | | | | |
|---|---|---|---|---|
| 6,440,256 | B1 | 8/2002 | Gordon et al. | |
| 7,910,145 | B2 * | 3/2011 | Reati | B26F 1/40 426/425 |
| 8,276,639 | B2 | 10/2012 | Binacchi | |
| 9,428,329 | B2 * | 8/2016 | Trombetta | B65D 85/8043 |
| 2009/0211713 | A1 | 8/2009 | Binacchi | |
| 2012/0269933 | A1 | 10/2012 | Rapparini | |
| 2013/0209618 | A1 * | 8/2013 | Trombetta | A47J 31/06 426/115 |
| 2015/0128525 | A1 * | 5/2015 | Bartoli | B65B 29/02 53/410 |

FOREIGN PATENT DOCUMENTS

| | | | |
|---|---|---|---|
| EP | 2093148 | A1 | 8/2009 |
| WO | 2011047836 | A1 | 4/2011 |

* cited by examiner

METHOD AND MACHINE FOR PRODUCING A SINGLE-USE CAPSULE FOR BEVERAGES AND CAPSULE OBTAINED USING METHOD

TECHNICAL FIELD

This invention relates to a method and a machine for producing a single-use capsule for beverages.

In particular, the single-use capsule referred to in this text is of the "extraction" type, having an external rigid body (preferably without an outer wrapper) and which can be used in machines for making beverages such as coffee.

BACKGROUND ART

The type of capsule in this text comprises, in the prior art solutions:

- a cup-shaped external rigid body comprising a bottom which can be pierced and a top opening provided with a collar (normally, but without presenting limits, defining a frustoconical shape);
- a liquid filtering chamber, engaging with the top opening of the external body and housed inside the body itself, to define a containment and infusion chamber for a product (for example powders or granules) to be mixed with a pressurised liquid;
- a flexible sheet for hermetically sealing the top opening of the rigid body and of the filtering chamber and intended (usually, but without presenting limits) to be pierced by a nozzle for feeding a pressurised liquid.

The capsule made in that way is used in machines for dispensing beverages comprising a seat for housing said capsules.

The capsule sheet lid is pierced by a tip for supplying the pressurised liquid (hot water) which is distributed in the filter element and descends evenly in the body, mixing with the powdered or granulated product.

In light of this, the bottom of the rigid body can be pierced using various types of units such as pointed and hollow elements designed to penetrate deeply and guide the mixture obtained towards the dispensing nozzle.

A method and a machine for producing this type of capsules is known from patent document EP 2.093.148.

DISCLOSURE OF THE INVENTION

The aim of this invention is to provide a method for producing a single-use capsule for beverages which allows the rapid, simple production of a capsule and increases capsule component forming and joining precision. Another aim of this invention is to provide a machine for producing the single-use capsule for beverages, which are obtained using the method according to this invention, the machine being simplified and having high productivity in a unit of time.

These aims are fulfilled by the method and the machine for producing a single-use capsule for infusion beverages according to this invention, comprising the features as described in the appended claims.

In particular, the method for producing a single-use capsule for extraction beverages comprises the steps of: positioning a flat piece of filter paper over a cup-shaped rigid body; joining the flat piece of filter paper along at least the rim of the rigid body; forming the piece of filter paper towards the interior of the rigid body and by means of plastic deformation of the piece of filter paper so as to define a containment chamber; filling of the containment chamber with a dose of product; closing of the chamber and of the external rigid body with a sheet lid.

This method makes the relative position of the internal filtering chamber and the external body more precise, since two flat surfaces can initially be worked on, and at the same time makes the perimetral joining zone between the rims of the two elements safer and more secure both during the joining step and during the forming step.

That feature makes the operating steps of the method and on the machine much faster and more precise, improving productivity in a unit of time.

BRIEF DESCRIPTION OF THE DRAWINGS

These and other features of the invention will become more apparent from the following description of a preferred, non-limiting embodiment of it, with reference to the accompanying drawings, in which.

DETAILED DESCRIPTION OF THE PREFERRED EMBODIMENTS OF THE INVENTION

Figure 1:
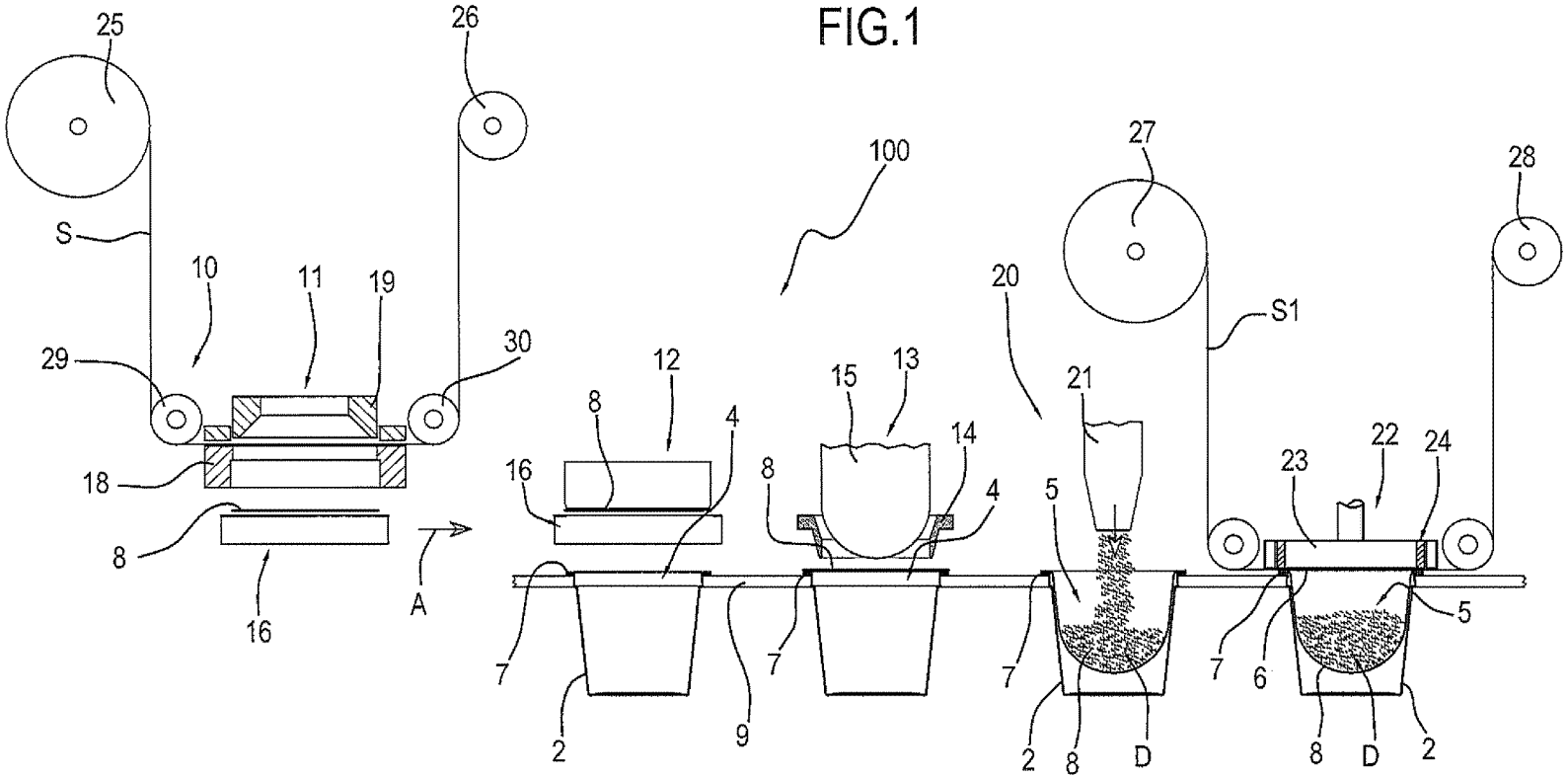
FIG. 1 is a schematic front view of a machine implementing the method for producing a single-use capsule for beverages of the extraction type in accordance with this invention.

With reference to the accompanying drawings, in particular FIG. 1, the method disclosed is used to produce single-use capsules 1, of the extraction type, for beverages.

Figure 2:
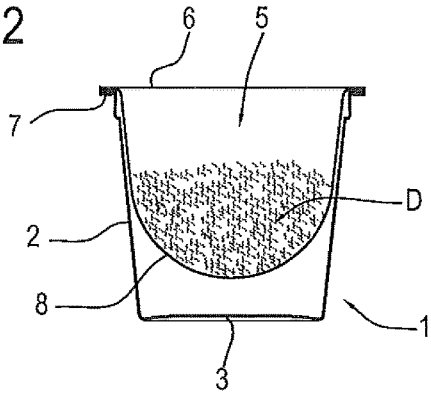
FIG. 2 is a front view with some parts cut away to better illustrate others of a single-use capsule for beverages obtained using the method and the machine in accordance with this invention.

In particular (see FIG. 2), the capsule 1 according to this invention comprises a cup-shaped external rigid body 2 comprising a closed bottom 3 and a top opening 4.

The rigid body 2 preferably has a frustoconical cross-section with the bottom 3 extending below the top opening 4.

The top opening 4 is preferably delimited by a rim 7 consisting of a circular collar extending outwards from the top opening 4.

The top opening 4 of the rigid body 2 is coupled with a filter designed to extend, with a concave cross-section, into the body 2 to form a chamber 5 for containing a dose D of product.

A rigid or flexible sheet lid 6 is positioned in such a way that it closes the top opening 4 of the rigid body 2 along the external rim 7 of the body 2, that is to say, associated with the collar 7.

It should be noticed that the expression extraction capsule refers to a capsule 1 which can be used in beverage making machines in which the sheet lid 6 is affected by a flow of pressurised liquid in two ways, depending on the machine in which the capsule 1 is used:

the sheet lid 6 is already pierced and rendered permeable to the liquid which descends towards the chamber 5 and mixes with the product;

the sheet lid 6 is intact and is pierced by pointed units (not illustrated since they are not part of the invention) to allow the pressurised inflow of liquid (for example water) so that the product and the liquid are mixed in the internal chamber 5.

The filter paper forming the walls of the internal chamber 5 allows filtering of the beverage obtained inside the lower zone of the rigid body 2.

The bottom 3 of the rigid body 2 is in turn pierced by units designed to convey the beverage obtained towards the beverage dispensing nozzles. According to the invention, the method for producing the capsules 1 comprises at least the following steps (see FIG. 1):

positioning a flat piece 8 of filter paper over the rigid body 2;

joining the flat piece 8 of filter paper along at least the rim 7 of the rigid body 2;

forming the piece 8 of filter paper towards the interior of the rigid body 2 and by means of a plastic deformation of the piece 8 of filter paper defining the containment chamber 5;

filling the containment chamber 5 with a dose D of product;

closing the chamber 5 and the external rigid body 2 with the sheet lid 6.

Thanks to this sequence of steps, the positioning and joining (by sealing or gluing, as seen below) of the filter paper 8 on the top opening 4 of the rigid body is extremely precise thanks to the fact that the two contact surfaces are flat at that moment.

Forming of the filter paper into its final shape to define the internal chamber 5 is carried out after joining it to the rigid body 2, leaving the external joining portion unchanged.

Said forming step preferably comprises:

a first sub-step of preforming the flat piece 8 of filter paper to form a partial concavity of the piece 8 towards the interior of the rigid body 2 and a second sub-step of complete forming of the piece 8 of filter paper to define the definitive shape of the containment chamber 5.

This option allows forming of the piece 8 of filter paper to be modulated, thereby avoiding the risks of breaks created by an immediate forming step on the piece of filter paper already peripherally joined to the rigid body 2.

In light of this, during the first, preforming sub-step (see FIGS. 3 and 5) at least a peripheral annular zone 8*a* of the piece 8 of filter paper close to the rim 7 of the rigid body 2 is plastically deformed to stretch said peripheral annular zone 8*a*.

Figure 4:
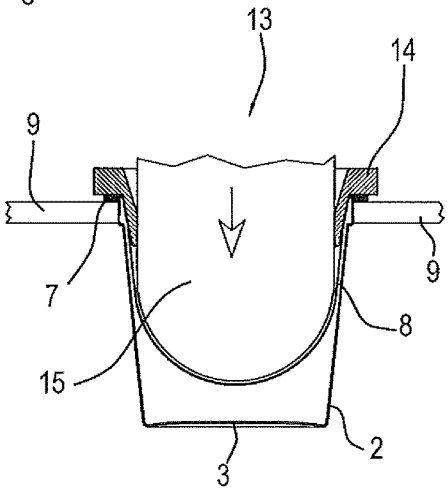
Figure 6:
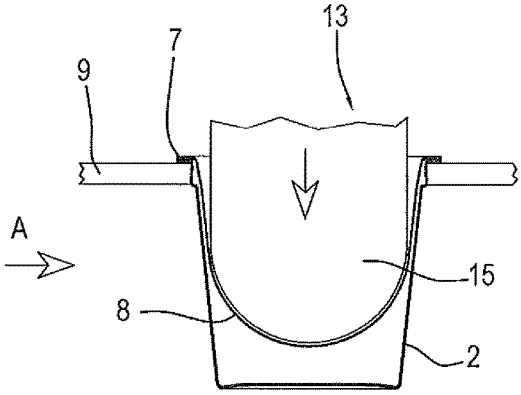

Also in light of this, during the second sub-step of complete forming of the piece 8 of filter paper, at least a central portion of the piece of 8 of filter paper is affected (see FIGS. 4 and 6).

Preferably, the step of forming of the piece 8 of filter paper is carried out by means of heat transfer.

It should be noticed that both of the sub-steps, of preforming and definitive forming of the piece 8 of filter paper, are carried out using heat transfer. Preferably, the step of positioning the flat piece 8 of filter paper (see FIGS. 7 and 8) comprises a step of cutting the piece 8 of filter paper from a continuous strip S of filter paper, so as to obtain a piece 8 matching the top surface of the external rigid body 2 (in this case, by way of example only, having a circular shape).

In light of this, the step of cutting the piece 8 of filter paper is immediately followed by the step of joining the piece 8 to the rim 7 of the rigid body 1 in an immediate sequence and in the same operating zone.

Alternatively, it should be noticed that the step of positioning the piece 8 of filter paper may comprise:

a step of cutting the piece 8 of filter paper from the continuous strip S of filter paper, so as to shape it to match the top surface of the external rigid body 2, and a step of moving the piece 8 of filter paper obtained by cutting onto the top opening 4 of the external rigid body 2.

This option of moving the piece 8 of filter paper is preferably carried out if the joining step comprises hot sealing which could interfere with the cutting units and therefore with piece 8 cutting precision.

In light of this, the step of joining the piece 8 of filter paper and the rim 7 of the rigid body can be carried out by means of sealing, that is to say, the passage of heat.

Alternatively, the step of joining the piece 8 of filter paper and the rim 7 of the rigid body can be carried out by gluing, that is to say, by spreading a layer of glue between the rim 7 and an external peripheral zone of the piece 8 of filter paper.

This invention also relates to a machine 100 for producing the single-use capsule 1 for extraction beverages.

The machine 100 comprises:

a conveyor 9 for conveying cup-shaped external rigid bodies 2, for moving them one after another in a direction of feed A (see arrow A in FIG. 1); and feed means 10 for feeding flat filter paper and designed to position the filter paper along at least one stretch of the feed line A.

According to the invention, the machine 100 also comprises, also along the direction of feed A:

cutting units 11 for cutting the filter paper to obtain a flat piece 8 of filter paper matching the top surface of the rigid body 2 (in practice the collar-shaped rim 7);

joining means 12 for perimetrally joining the flat piece 8 of filter paper along the rim 7 of the top opening 4 of the rigid body 2;

forming means 13 for forming the flat piece 8 of filter paper joined to the rigid body 2, said forming means being positioned downstream of the joining means 12 for perimetrally joining the flat piece 8 of filter paper relative to the direction of feed A, and acting on the flat piece 8 so as to plastically deform the piece 8 towards the interior of the rigid body 2 to define a chamber 5 for containing the dose D of product inside the rigid body 2.

Preferably (as shown in FIGS. 1 and from 3 to 6) the forming means 13 comprise:

a first punch 14 for preforming the flat piece 8 of filter paper and designed to stretch at least a peripheral annular zone 8*a* of the piece 8 of filter paper, close to the rim 7 of the rigid body 2, according to a direction converging towards the interior of the rigid body 2 and a second punch 15 for completely forming the piece 8 of the filter paper, operatively coupled with the first punch 14, for deforming at least the central portion of the piece 8 of the filter paper so as to define the internal chamber 5.

Figure 3:
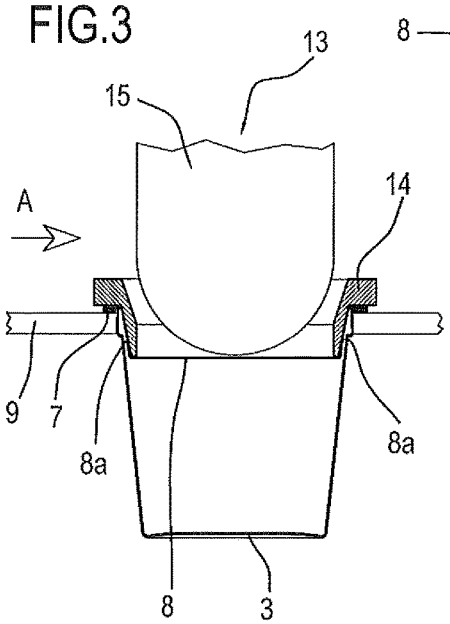
FIGS. 3 and 4 are schematic front views with some parts cut away to better illustrate others of a step of forming a chamber inside the capsule obtained using the machine of FIG. 1.

In a first embodiment, these forming means 13 constitute a single machine 100 operating station (as shown in FIGS. 1, 3 and 4) in which the first and second punches 14 and 15 are operatively coupled with each other so that they carry out the preforming and forming operations in sequence in a single machine 100 position by means of movements which are coordinated and in a direction transversal to the direction of feed.

In light of this, the first punch 14 comprises a heated ring-shaped element and has an angled external contact surface designed to stretch the peripheral annular zone 8*a* of the piece 8 of filter paper.

This hot stretching allows the creation of a sort of "flaring" of the edges of the filter paper so as to "render elastic" the zone of the filter paper close to the join with the rim 7 of the rigid body 2 and prevent tears during complete forming.

The second punch 15 comprises a heated nose-style (hemispheric) head able to move through the open central zone of the ring which constitutes the first punch 14 so as to act, by descending, on the remaining part of the piece 8 of filter paper to completely form the internal chamber 5 using heat.

Therefore, basically, the step of forming the internal chamber 5 is carried out by thermoforming.

According to a second embodiment, the machine 100 may comprise independent preforming means 14 for preforming the flat piece 8 of filter paper, said means being interposed between the perimetral joining means 12 and the forming means 13 for forming the piece 8 of filter paper relative to the direction of feed A.

In light of this, the preforming means 14 are designed to stretch at least the peripheral annular zone 8*a* of the piece 8 of filter paper close to the rim of the rigid body 2 according to a direction converging towards the interior of the rigid body 2.

Figure 5:
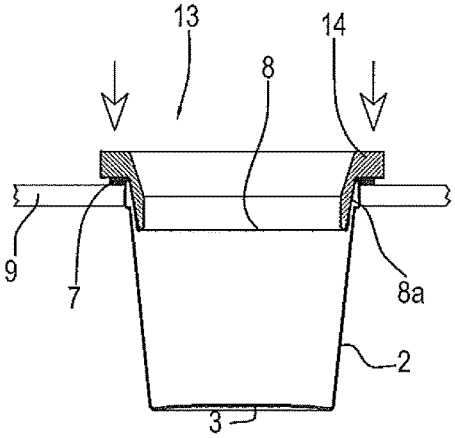
FIGS. 5 and 6 are schematic front views of an alternative embodiment of the step of forming the internal chamber of FIGS. 3 and 4.

In other words, as shown in FIGS. 5 and 6 the first punch 14 (for example like that described above) may be independent and positioned in an operating station upstream of the operating station of the second punch 15 for complete forming.

Again in this case, forming of the internal chamber 5 is carried out using heat.

Figure 7:
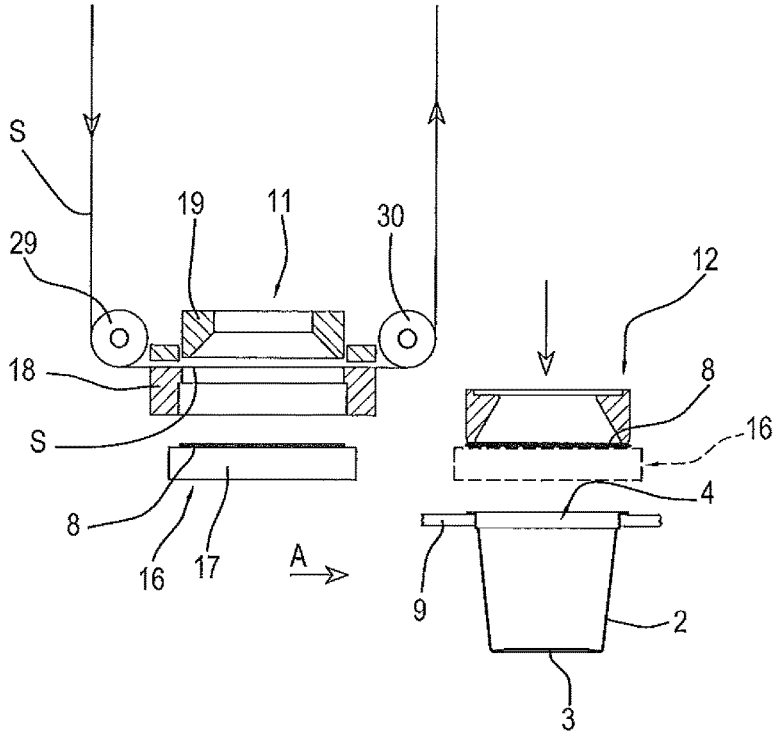
FIGS. 7 and 8 are schematic front views of two steps, one after another, of cutting and of joining a piece of filter paper on the top opening of an external rigid body, which are part of the method and the machine according to this invention.
Figure 8:
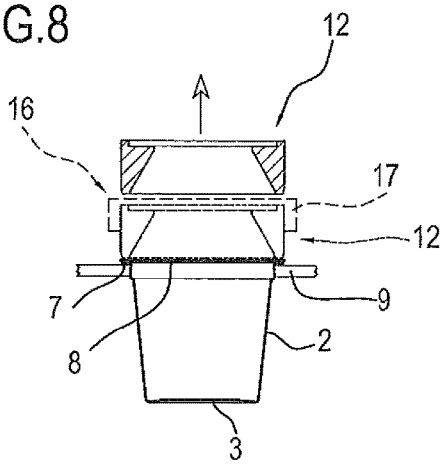

As illustrated in FIGS. 7 and 8, the cutting units 11 comprise a fixed die or contact element 18 and a knife 19 for cutting the piece 8 of filter paper from the continuous strip S.

The continuous strip S is fed by a reel 25, whilst the waste generated by cutting is recovered by a further reel 26.

These reels 25 and 26, together with a pair of return rollers 29 and 30 form the filter paper feed means 10.

In light of this, a first embodiment comprises the possibility of having the cutting units 11 and the joining means 12 in a single machine 100 station and using coordinated movement in a direction transversal to the direction of feed A.

In this single station, both cutting the piece 8 of filter paper and, in sequence, joining of the piece 8 to the rim 7 of the rigid body 2 are carried out.

According to a second embodiment, the machine 100 comprises two separate stations for cutting 11 and joining 12, located one after another along the direction of feed A.

For this second embodiment, the machine 100 comprises units 16 for receiving the piece 8 of filter paper obtained by the cutting units 11.

The units 16 for receiving the piece 8 of filter paper are designed to move the piece 8 of filter paper along the direction of feed A to the operating zone of the joining means 12 for perimetrally joining the piece 8 of filter paper to the rim 7 of the rigid body 2.

In particular, these units 16 for receiving and moving the piece 8 of the filter paper comprise a movable platform 17 for supporting the piece 8 of filter paper and designed to release the piece 8 of filter paper onto the top surface of the rigid body 2.

It should be noticed that the platform 17 can move parallel with the direction of feed A and at a height higher than the position of the top rim 7 of the rigid body 2.

In light of this, the platform 7 may be provided with spring release units (not illustrated here) for operating in a way synchronised with the joining means 12 and allowing controlled positioning of the piece 8 on the rim 7, and its joining to the rim (see FIG. 8).

Also in light of this, the joining means 12 may comprise sealing units (such as a sealing plate designed to match the annular shape of the piece 8 of filter paper and of the rim 7) for joining using heat transfer.

Alternatively, the joining means 12 may comprise gluing units, that is to say, for spreading glue along the rim 7 of the rigid body 2.

The conveyor 9 may comprise a belt with spaced out holders for the rigid bodies 2 resting on the rim 7.

The belt 9 moves the rigid bodies 2, with a stepping motion or continuous motion, along the direction of feed A to bring the rigid bodies 2 to the various operating stations located above the rim 7 for carrying out the various steps one after another.

Therefore, the belt 9 also acts as a contact element during operations for joining the piece 8 of filter paper to the rim 7 of the rigid body 2 and for forming the internal chamber 5.

The machine 100 also comprises, after the forming means 13, a further set of stations for completing the capsule 1.

As shown in FIG. 1, the machine 100 comprises, downstream of the forming means 13 relative to the direction of feed A, a station 20 for filling the internal chamber 5 with the product (powdered or granulated).

This station 20 may comprise at least one product dosing unit 21 located above the rigid body 2 and the internal chamber 5.

The machine 100 also comprises a station 22 for closing the top opening 4 of the rigid body 2. This station is downstream of the dosing station 20 again relative to the direction of feed A.

This closing station 22 comprises a cutter element 23 for cutting the sheet lid 6 from a continuous strip S1 of this material.

Moreover, the station 22 comprises means 24 for associating the sheet lid 6 obtained with the rim 7 of the rigid body 2 with which a part of the piece 8 of filter paper is also associated.

In this case too, the associating means 24 are designed to join the sheet lid 6 using heat transfer.

The continuous strip S1 of material is fed by a reel 27, whilst the waste generated by cutting the sheet lids 6 is recovered by a further reel 28.

The method and the machine structured in this way fulfil the preset aims.

The joining and thermoforming of the filter paper, performed starting with a flat piece of filter paper, allow a high quality capsule to be obtained.

In fact, the relative position of the internal filtering chamber and the external body is extremely precise, since two flat surfaces can initially be worked on, and at the same time the perimetral joining zone between the rims of the two elements is made safer and more secure.

This much faster, more precise structure of the operating steps of the method improving productivity in a unit of time even on the machine.

The invention claimed is:

1. A method for producing a single-use capsule (1) for beverages comprising a cup-shaped external rigid body (2) comprising a closed bottom (3) and a top opening (4) coupled with a filter extending, with a concave cross-section, into the body (2) to form a chamber (5) for containing a dose (D) of product, and a sheet lid (6) for closing the top opening (4) of the rigid body (2) along an external rim (7) of the body (2), characterised in that it comprises the following steps in this sequence:

positioning a flat piece (8) of filter paper over the rigid body (2);

joining the flat piece (8) of filter paper along at least the rim (7) of the rigid body (2);

forming the piece (8) of filter paper towards the interior of the rigid body (2) and by means of a plastic deformation of the piece (8) of filter paper to define the containment chamber (5);

filling the containment chamber (5) with a dose (D) of product;

closing the chamber (5) and the external rigid body (2) with the sheet lid (6).

2. The method according to claim 1, wherein the forming step comprises:

a first sub-step of preforming the flat piece (8) of filter paper to form a partial concavity of the piece (8) towards the interior of the rigid body (2) and a second sub-step of complete forming of the piece (8) to define the shape of the containment chamber (5).

3. The method according to claim 2, wherein in the first, preforming sub-step at least a peripheral annular zone (8*a*) of the piece (8) of filter paper close to the rim (7) of the rigid body (2) is plastically deformed to stretch said peripheral annular zone (8*a*).

4. The method according to claim 2, wherein in the second sub-step of complete forming of the piece (8) of filter paper, at least a central portion of the piece (8) of filter paper is affected.

5. The method according to claim 1, wherein forming of the piece (8) of filter paper is achieved by means of heat transfer.

6. The method according to claim 1, wherein the step of positioning the flat piece (8) of filter paper comprises a step of cutting the piece (8) of filter paper from a continuous strip (S) of filter paper, so as to obtain a piece (8) matching a top surface of the external rigid body (2).

7. The method according to claim 1, wherein the step of positioning the piece (8) of filter paper comprises:

a step of cutting the piece (8) of filter paper from a continuous strip (S) of filter paper, so as to shape it to match the top surface of the external rigid body (2), and a step of moving the piece (8) of filter paper obtained by cutting onto the top opening (4) of the external rigid body (2).

8. A machine for producing a single-use capsule for extraction beverages, comprising at least:

a conveyor (9) for conveying cup-shaped external rigid bodies (2), comprising a closed bottom (3) and a top opening (4), for moving them one after another in a direction of feed (A); and feed means (10) for feeding flat filter paper and designed to position the filter paper along at least one stretch of the feed line (A);

characterised in that the machine also comprises, along the direction of feed (A):

cutting units (11) for cutting the filter paper to obtain a flat piece (8) of filter paper matching a top surface of the rigid body (2);

joining means (12) for perimetrally joining the flat piece (8) of filter paper on the top opening (4) of the rigid body (2) defined by a top rim (7);

forming means (13) for forming the flat piece (8) of filter paper joined to the rigid body (2), said forming means being positioned downstream of the joining means (12) for perimetrally joining the flat piece (8) of filter paper relative to the direction of feed (A), and acting on the flat piece (8) of filter paper so as to plastically deform the piece (8) of filter paper towards a interior of the rigid body (2) to define a chamber (5) for containing a dose (0) of product inside the rigid body (2).

9. The machine according to claim 8, wherein said forming means (13) comprise:

a first punch (14) for preforming the flat piece (8) of filter paper and designed to stretch at least a peripheral annular zone (8*a*) of the piece (8) of filter paper, close to the rim of the rigid body (2), according to a direction converging towards the interior of the rigid body (2) and a second punch (15) for completely forming the piece (8) of the filter paper, operatively coupled with the first punch (14), for deforming at least the central portion of the piece (8) of the filter paper so as to define the internal chamber (5).

10. The machine according to claim 8, comprising preforming means (14) for preforming the flat piece (8) of filter paper, interposed between the perimetral joining means (12) and the forming means (13) for forming the piece (8) of filter paper relative to the direction of feed (A), said preforming means (14) being designed to stretch at least a peripheral annular zone (8*a*) of the piece (8) of filter paper close to the rim of the rigid body (2) according to a direction converging towards the interior of the rigid body (2).

11. The machine according to claim 8, comprising units (16) for receiving the piece (8) of fitter paper obtained by the cutting units (11) and designed to move the piece (8) of filter paper along the direction of feed (A) to the operating zone of said joining means (12) for perimetrally joining the flat piece (8) of filter paper to the top rim (7) of the rigid body (2).

12. The machine according to claim 11, wherein said units (16) for receiving and moving the piece (8) of the filter paper comprise a movable platform (17) for supporting the piece (8) of filter paper and designed to release the piece (8) of filter paper onto the top surface of the rigid body (2).

* * * * *